US011605922B2

(12) United States Patent
Chen et al.

(10) Patent No.: US 11,605,922 B2
(45) Date of Patent: Mar. 14, 2023

(54) ELECTRICAL CONNECTOR HAVING AN OUTER SHELL AND AN INNER SHIELD TO DEFINE AN ENGAGING GROOVE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: De-Jin Chen, Kunshan (CN); Lai-Hang Lv, Kunshan (CN); Xian-Wei Feng, Kunshan (CN); Yu-San Hsiao, New Taipei (TW); Shih-Wei Hsiao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 3 days.

(21) Appl. No.: 17/359,646

(22) Filed: Jun. 28, 2021

(65) Prior Publication Data

US 2021/0408732 A1 Dec. 30, 2021

(30) Foreign Application Priority Data

Jun. 28, 2020 (CN) ..... 202010599011.1

(51) Int. Cl.
*H01R 13/6582* (2011.01)
*H01R 13/40* (2006.01)
(Continued)

(52) U.S. Cl.
CPC ..... *H01R 13/6582* (2013.01); *H01R 13/40* (2013.01); *H01R 13/502* (2013.01);
(Continued)

(58) Field of Classification Search
CPC .. H01R 13/6582; H01R 13/40; H01R 13/502; H01R 13/516; H01R 13/6271;
(Continued)

(56) References Cited

U.S. PATENT DOCUMENTS

| | | | | |
|---|---|---|---|---|
| 10,601,181 | B2 * | 3/2020 | Lu | H01R 12/79 |
| 2017/0229817 | A1 | 8/2017 | Tsai et al. | |
| 2020/0266584 | A1 * | 8/2020 | Lu | H01R 12/75 |

FOREIGN PATENT DOCUMENTS

| | | | |
|---|---|---|---|
| CN | 203690571 | U | 7/2014 |
| CN | 206524432 | U | 9/2017 |

(Continued)

*Primary Examiner* — Abdullah A Riyami
*Assistant Examiner* — Justin M Kratt
(74) *Attorney, Agent, or Firm* — Ming Chieh Chang

(57) ABSTRACT

An electrical connector includes an insulative housing having a mating slot; a contact module received in the insulative housing, a metallic outer shell enclosing the insulative housing and having a latching portion spaced apart from a side wall of the insulative housing, and a metallic inner shield secured between the insulative housing and the metallic outer shell, wherein the metallic inner shield has a planar portion adjacent to the side wall of the insulative housing and a pair of bulging portions at two opposite ends of the planar portion, and the latching portion of the metallic outer shell and the planar portion and the bulging portions of the metallic inner shield together define an engaging groove.

4 Claims, 7 Drawing Sheets

(51) Int. Cl.

| | |
|---|---|
| ***H01R 13/502*** | (2006.01) |
| ***H01R 13/516*** | (2006.01) |
| ***H01R 13/627*** | (2006.01) |
| *H01R 13/62* | (2006.01) |
| *H01R 13/6581* | (2011.01) |
| *H01R 13/6594* | (2011.01) |
| *H01R 12/57* | (2011.01) |
| *H01R 13/46* | (2006.01) |

(52) U.S. Cl.
CPC ..... *H01R 13/516* (2013.01); *H01R 13/6271* (2013.01); *H01R 12/57* (2013.01); *H01R 13/46* (2013.01); *H01R 13/62* (2013.01); *H01R 13/627* (2013.01); *H01R 13/6581* (2013.01); *H01R 13/6594* (2013.01)

(58) Field of Classification Search
CPC ..... H01R 13/62; H01R 12/57; H01R 13/627; H01R 13/6594; H01R 13/6581; H01R 13/46
See application file for complete search history.

(56) References Cited

FOREIGN PATENT DOCUMENTS

| | | | |
|---|---|---|---|
| CN | 206820190 | U | 12/2017 |
| CN | 208045830 | U | 11/2018 |
| CN | 210245775 | U | 4/2020 |

* cited by examiner

ELECTRICAL CONNECTOR HAVING AN OUTER SHELL AND AN INNER SHIELD TO DEFINE AN ENGAGING GROOVE

BACKGROUND OF THE INVENTION

1. Field of the Invention

The present invention relates to an electrical connector including an insulative housing, a contact module received in the insulative housing, and a metallic outer shell enclosing the insulative housing and having a latching portion (410) spaced apart from a side wall of the insulative housing, wherein as a design improvement a metallic inner shield is provided between the insulative housing and the metallic outer shell.

2. Description of Related Arts

China Patent No. 208045830 discloses an electrical connector having an engaging groove that is defined by an insulative housing and a metallic outer shell thereof. During insertion of a complementary mating connector, a side wall of the insulative housing facing and defining the engaging groove is apt to damage. Moreover, shielding effectiveness of the metallic outer shell is compromised due to presence of the engaging groove that spaces the metallic outer shell a certain distance apart from the side wall of the insulative housing.

SUMMARY OF THE INVENTION

An electrical connector comprises an insulative housing having a mating slot, a contact module received in the insulative housing, a metallic outer shell enclosing the insulative housing and having a latching portion spaced apart from a side wall of the insulative housing, and a metallic inner shield secured between the insulative housing and the metallic outer shell, wherein the metallic inner shield has a planar portion adjacent to the side wall of the insulative housing and a pair of bulging portions at two opposite ends of the planar portion, and the latching portion of the metallic outer shell and the planar portion and the bulging portions of the metallic inner shield together define an engaging groove.

DETAILED DESCRIPTION OF THE PREFERRED EMBODIMENTS

Figure 1:
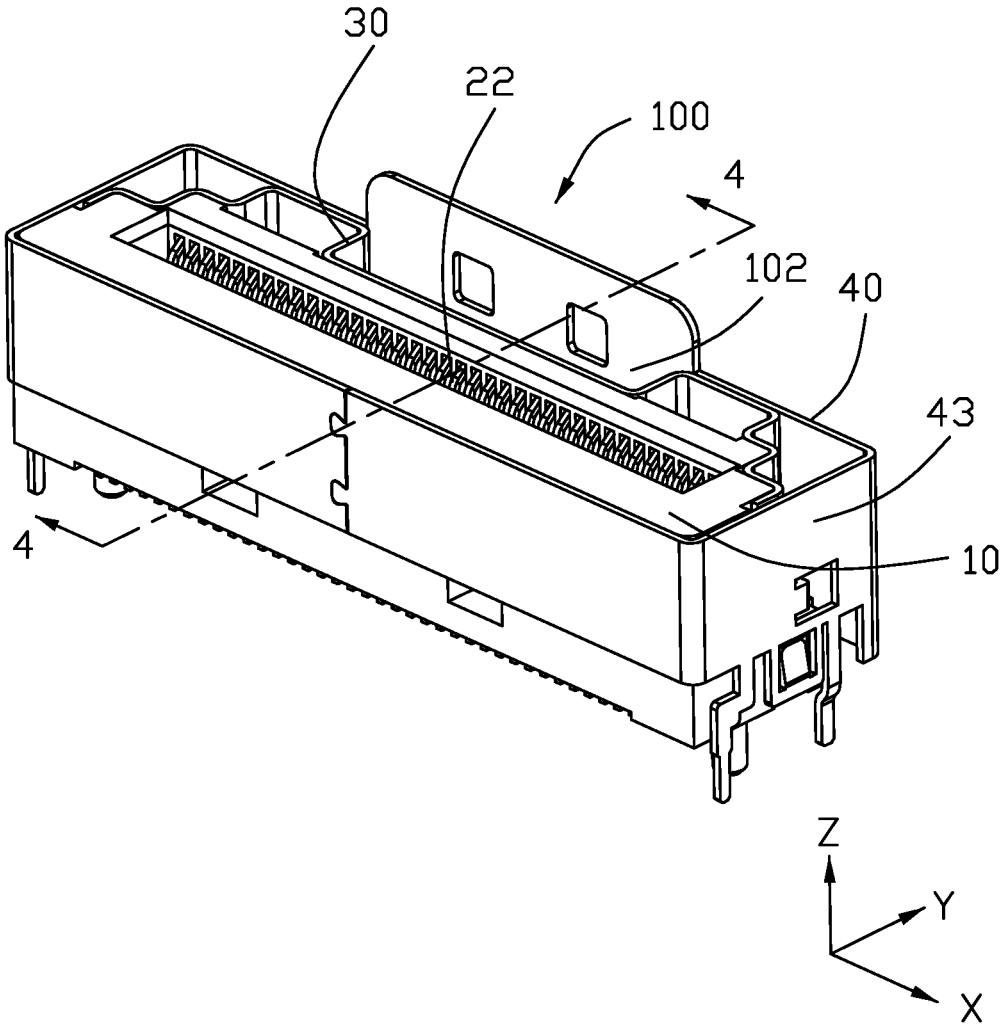
FIG. 1 is a perspective view of an electrical connector in accordance with the present invention.
Figure 2:
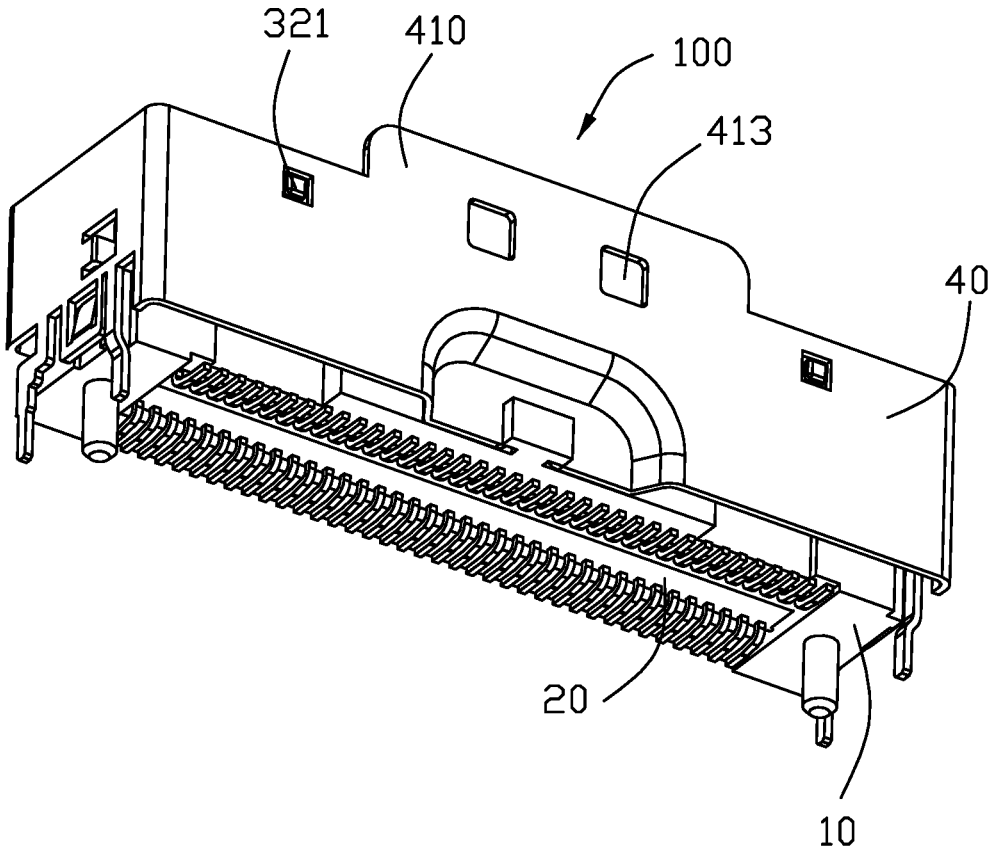
FIG. 2 is another perspective view of the electrical connector.

Referring to FIGS. 1-7, an electrical connector 100 of a vertical type has a mating direction along Z-axis. The electrical connector 100 may be a right-angle type as well so as to have a horizontal mating direction.

The electrical connector 100 includes an insulative housing 10 elongated along X-axis, a contact module 20 (a left one and a right one in the embodiment shown) received in the insulative housing 10, a metallic outer shell 40 enclosing the insulative housing 10, and a metallic inner shield 30 secured between the insulative housing 10 and the metallic outer shell 40.

The insulative housing 10 has a mating face 11 and a mounting face 12, a mating slot 13 through the mating face 11, a first and a second side walls 14 and 15, two end walls 16, and a mounting groove 18 through the mounting face 12. Contact-receiving grooves 17 are formed on the first and second side walls 14 and 15.

The contact module 20 has an insulator 21 and a plurality of contacts 22. The insulator 21 has a protrusion 211, a slot 212, and one or more blocks 213. Each of the first and second side walls 14 and 15 for has corresponding holes 141. Each contact 22 has a contacting portion 221, a mounting portion 223, and a connecting portion 222.

The metallic outer shell 40 has a board 41, a side wall 42, and a pair of end walls 43, together defining a receiving space 401. The board 41 is spaced a distance from the first side wall 14 of the insulative housing 10 and has a pair of holes 413. The board 41 has a latching portion 410 containing the pair of holes 413 which are substantially leveled with a top edge of the side and end walls 42 and 43.

The metallic inner shield 30 has a planar portion 31 adjacent to the first side wall 14 of the insulative housing 10 and a pair of bulging portions 32 at two opposite ends of the planar portion 31. The planar portion 31 and the pair of bulging portions 32 of the metallic inner shield 30 and the latching portion 410 of the metallic outer shell 40 together define an engaging groove 102.

The side wall 14 has a depression 142 for accommodating the planar portion 31. There are respective L-shaped notches 146 and 161 at a junction of the side wall 14 and each end wall 16. Continuing each bulging portion 32 there are respective first L-shaped portion 33 consisting of portions 331, 332 and second L-shaped portion 34 consisting of portions 341, 342 received by corresponding notches 146 and 161. Each bulging portion 32, first L-shaped portion 33, and second L-shaped portion 341 and the metallic outer shell 40 define a respective L-shaped groove 103 for positioning a corresponding feature of a complementary mating connector.

Figure 3:
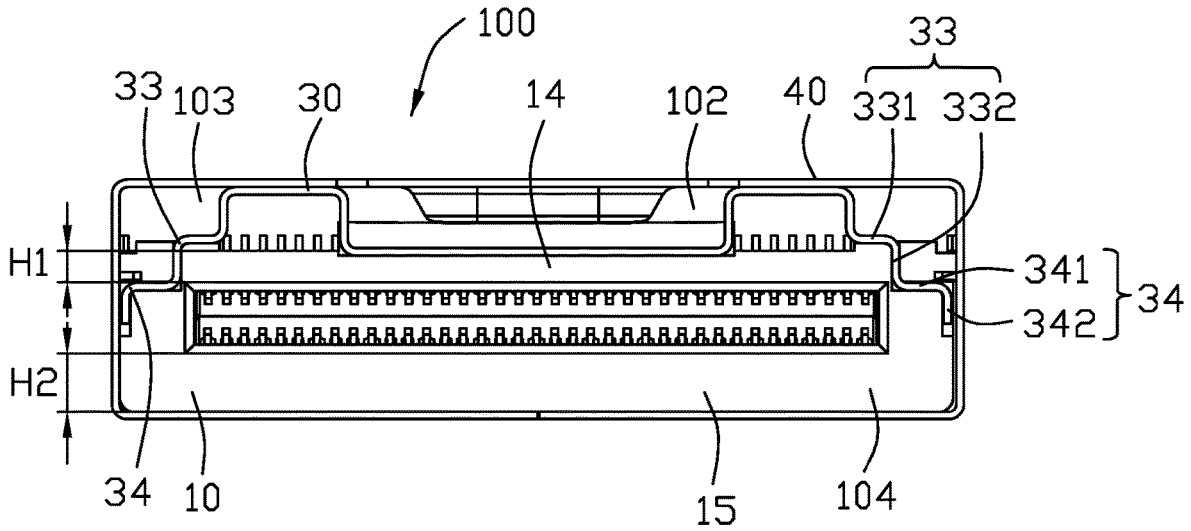
FIG. 3 is a top plan view of the electrical connector.
Figure 4:
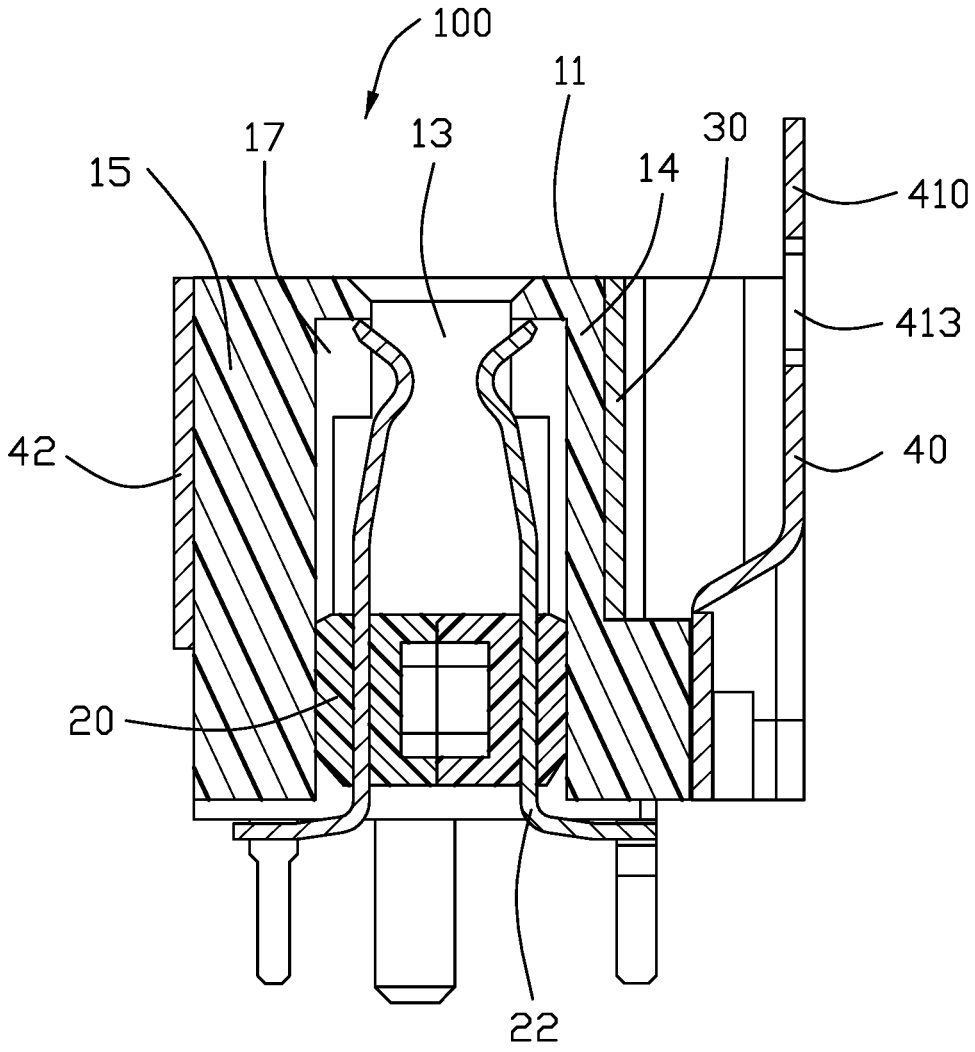
FIG. 4 is a cross-sectional view of the electrical connector taken along line A-A in FIG. 1.
Figure 5:
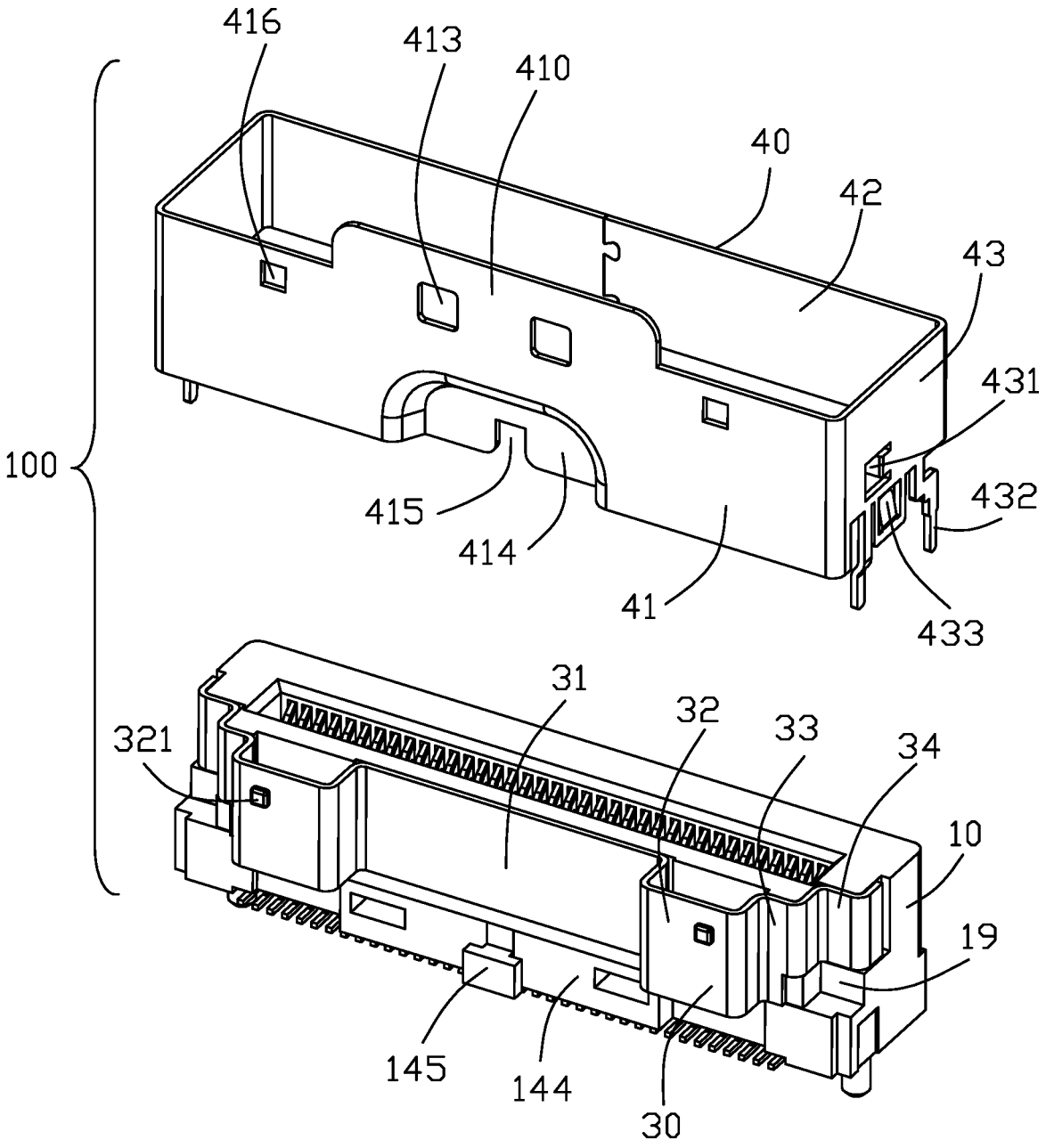
FIG. 5 is an exploded view of the electrical connector in FIG. 1.
Figure 6:
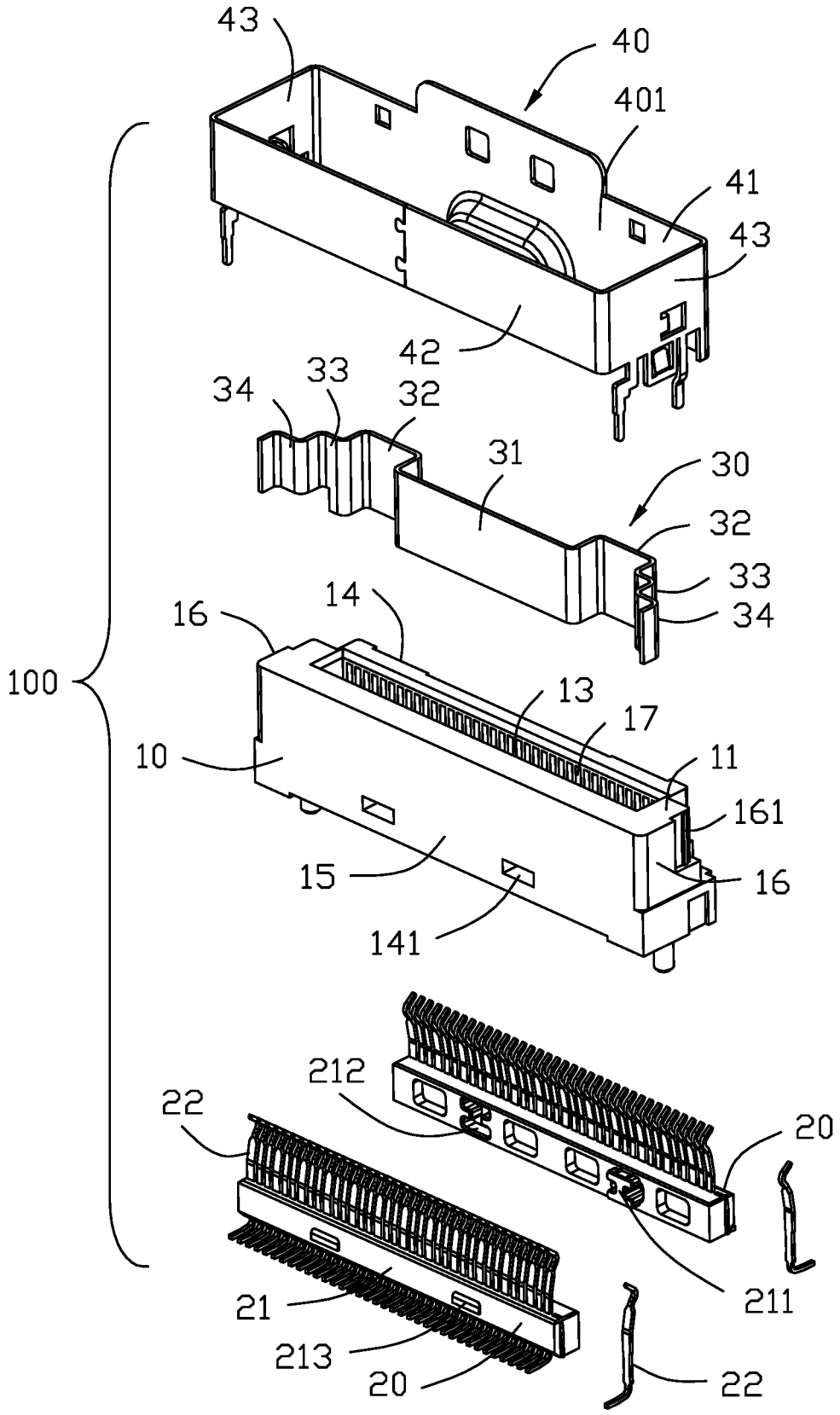
FIG. 6 is a further exploded view of the electrical connector in FIG. 5.
Figure 7:
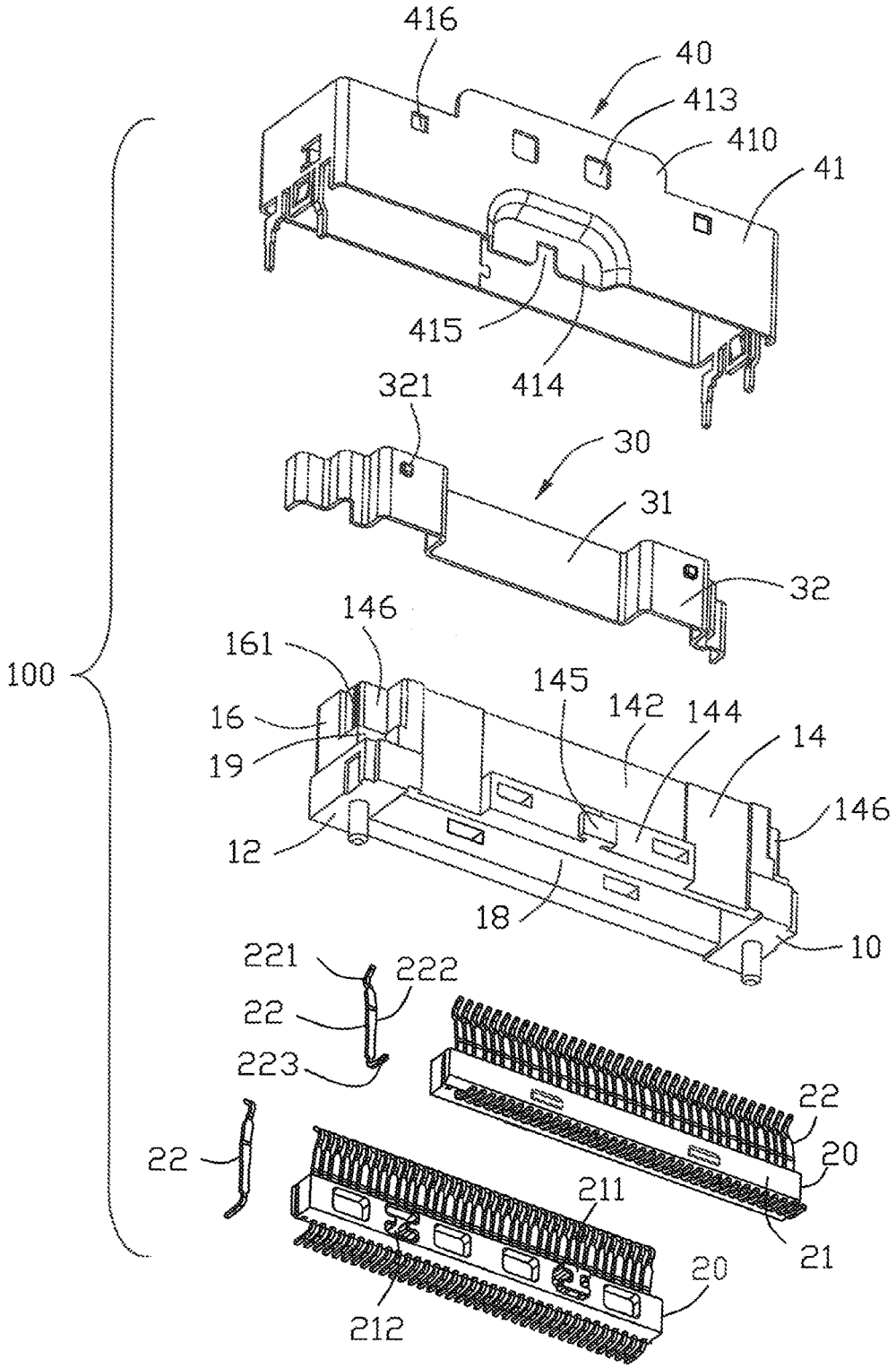
FIG. 7 is a view similar to FIG. 6 but from another perspective.

Referring specifically to FIG. 3, provision of the metallic inner shield 30 divides the receiving space 401 into four regions: first region 104 that is well shielded, second region that contains the engaging groove 102 for latching purpose, and third and fourth regions that contain the L-shaped grooves 103 for proper positioning purpose.

The first side wall 14 has a thickness H1, along Y-axis, which is less than a thickness H2 of the second side wall 15. That is, the planar portion 31 of the metallic inner shield 30 does not in effect increase overall thickness of the first side wall because structural strength of the first side wall of a reduced thickness is instead reinforced by the metallic planar portion 31. At a bottom of the first side wall 14 there is a step 144 on which the planar portion 31 rests. A combined thickness of the step 144 and the first side wall 14 is substantially equal to the thickness of the second side wall 15. The step 144 has a lug 145. The board 41 of the metallic outer shell 40 includes an extension 414 which has a slot 415 for engaging the lug 145.

Each bulging portion 32 is substantially U-shaped and bears against the board 41 to effectuate shielding function. Each bulging portion 32 has a protrusion 321 and the board 41 has a pair of holes 416 for receiving the protrusions 321.

In this embodiment, the metallic inner shield 30 and the metallic outer shell 40 are separately formed. It is also contemplated that metallic inner shield and outer shell may be formed as an integral piece. The insulative housing 10 has a pair of slots 19 beside the first side wall 14 for receiving a pair of claws 431. Each end wall 43 has a pair of legs 432 and a clip 433.

The present invention achieves better shielding effect on the first side wall side while maintaining a structural strength of the first side wall.

What is claimed is:

1. An electrical connector comprising:

an insulative housing having a mating slot;

a contact module received in the insulative housing;

a metallic outer shell enclosing the insulative housing and having a latching portion spaced apart from a side wall of the insulative housing; and a metallic inner shield secured between the insulative housing and the metallic outer shell; wherein the metallic inner shield has a planar portion adjacent to the side wall of the insulative housing and a pair of bulging portions at two opposite ends of the planar portion; and the latching portion of the metallic outer shell and the planar portion and the bulging portions of the metallic inner shield together define an engaging groove.

2. The electrical connector as claimed in claim 1, wherein the insulative housing has an opposite side wall, and a thickness of said side wall is less than a thickness of the opposite side wall.

3. The electrical connector as claimed in claim 1, wherein the pair of bulging portions abut against the metallic outer shell.

4. The electrical connector as claimed in claim 1, wherein the metallic inner shield and the metallic outer shell are separately formed.

* * * * *